US006957615B1

(12) United States Patent
Landoni

(10) Patent No.: US 6,957,615 B1
(45) Date of Patent: Oct. 25, 2005

(54) METHOD AND DEVICE TO APPLY CORD THREAD OR RIBBONS ONTO FABRICS IN A QUILTING MACHINE

(75) Inventor: Giannino Landoni, Fagnano Olona (IT)

(73) Assignee: MECA S.p.A., Fagnano Olona (IT)

( * ) Notice: Subject to any disclaimer, the term of this patent is extended or adjusted under 35 U.S.C. 154(b) by 0 days.

(21) Appl. No.: 09/979,810

(22) PCT Filed: May 11, 2000

(86) PCT No.: PCT/IB00/00630

§ 371 (c)(1),
(2), (4) Date: Nov. 14, 2001

(87) PCT Pub. No.: WO00/70137

PCT Pub. Date: Nov. 23, 2000

(30) Foreign Application Priority Data

May 14, 1999 (IT) ..... UD99A0097

(51) Int. Cl.[7] ..... D05C 7/08
(52) U.S. Cl. ..... 112/117
(58) Field of Search ..... 112/117, 116, 260, 112/302, 475.18, 181, 99, 100, 101, 163

(56) References Cited

U.S. PATENT DOCUMENTS 2,687,703 A 8/1954 Shotsky
2,831,445 A * 4/1958 Kuhn ..... 112/254
4,438,713 A * 3/1984 Kato ..... 112/100
4,640,209 A * 2/1987 Glenn et al. ..... 112/429
4,867,086 A * 9/1989 Vees et al. ..... 112/475.04
5,022,336 A * 6/1991 Iwase ..... 112/304
5,685,249 A 11/1997 Zeller
5,967,068 A * 10/1999 Landoni ..... 112/117

FOREIGN PATENT DOCUMENTS

| | | |
|---|---|---|
| CH | 563 486 | 6/1975 |
| DE | 501 908 | 7/1930 |
| FR | 467 481 A | 1/1914 |

* cited by examiner

*Primary Examiner*—Ismael Izaguirre
(74) *Attorney, Agent, or Firm*—Greenberg Traurig, LLP

(57) ABSTRACT

A device for applying an embroidery material onto a textile fabric including a device for feeding the textile material; an upper sewing organ having a needle bearing bar and a plurality of needles; a lower sewing organ selected from the group consisting of shuttles, rotary crochets and moving hooks cooperating with the upper organ. At least one pressure plate for compressing the material and having embroidery devices thereon and a drive for providing rotational motion to the embroidery devices, wherein the drive device includes a hole for each needle to pass through and a second hole for the embroidery material to pass through, and wherein the rotational motion is in a single direction so as to direct the second hole in a position that is in front of the needle to obtain stitches on the textile fabric and to fix the embroidery material.

2 Claims, 5 Drawing Sheets

METHOD AND DEVICE TO APPLY CORD THREAD OR RIBBONS ONTO FABRICS IN A QUILTING MACHINE

FIELD OF THE INVENTION

This invention concerns a device to apply cord thread or ribbons onto fabrics, simple or padded, in a quilting machine.

The invention also concerns a quilting machine, advantageously but not exclusively a multi-needle machine, equipped with this device.

The invention also concerns a method to apply a ribbon or cord thread onto fabrics, simple or padded, both continuously and also alternated with segments of simple sewing, in a quilting machine.

The invention is applied in the textile field and refers to the automatic application, by means of stitches suitable to achieve a desired pattern or ornamental design, of a cord thread, ribbon or trimming onto simple, multi-layer or padded fabrics fed continuously from rolls.

The invention is applied preferentially, but not exclusively, to multi-needle quilting machines, of the type which makes both knotted stitches and chain stitches.

The invention is characterized by the fact that it includes at least one pressure plate, co-operating with the needle-bearing bar, which supports a plurality of devices equipped with at least a rotary element with alternating or simple motion, able to direct the ribbons or trimming into a position which is always in front of the needle with respect to the direction of sewing, or to interweave around the needle and fix cord thread, trimming or ribbons, fed from appropriate reels, so that the cord thread, ribbons or trimmings are fixed onto the fabric by means of stitches, either continuously or alternated with simple stitches according to a defined working program.

BACKGROUND OF THE INVENTION

In the field of embroidering machines the state of the art includes the use of devices to automatically apply ribbons or cord thread onto fabrics cut into pieces.

These devices serve to make particular types of embossed embroidery; they work on pieces of a limited length, particularly on pieces worked on the tambour frame, in a discontinuous work pattern which gives limited productivity.

Moreover, the ornamental designs made by these devices are isolated, considerably distant from each other and discontinuous.

When these devices are used the embroidery machines have a very low working speed, in the region of 120 stitches a minute at most.

State of the art devices of this type, as they are used at present, are therefore not suitable for use on electronically controlled machines which continuously work fabric supplied from a roll, with speeds of at least 450 stitches a minute and which can reach up to 600+700 stitches a minute.

Such conventional devices are used only to apply large section cord thread or ribbons or chenille or embroidery thread (therefore unable to pass through the eye of a needle), on a base fabric.

In such devices the ribbons or embroidery threads are not made to pass through the fabric and are not fixed thereon by means of stitches made by needles which perforate them; they are fixed to the fabric by means of the stitches of a thin thread which passes above them and is anchored to the fabric once on one side and once on the opposite side of the embroidery threads (see for example FIG. 1 in CH-A-563.486).

In such devices, for this purpose, suitable wheels are provided equipped with an alternate rotary movement, generally produced by rectilinear racks; each wheel is provided with a central hole through which the needle with the fixing thread passes and an eccentric hole of a suitable diameter, through which passes the cord thread or the embroidery thread which has to be attached on the fabric.

While the needles carrying the fixing thread perform a normal stitching action, the alternating rotations of the wheels cause the cord threads or embroidery threads to be positioned alternately on one side and the other of the needles, and therefore cause the stitches made thereby to pass alternately from one side to the other above the cord threads or embroidery threads, thus fixing them to the fabric.

Among these conventional devices, the one described in CH-A-563.486 describes a device able to modify the position of the eccentric hole though which the embroidery thread passes, according to the orders to move given by an automatic embroidery machine commanded by a perforated belt, according to the rotation of the direction of stitching backwards-forwards-left-right, so that the rotation in one direction and the other of the wheels has its center, on each occasion, in the correlated main direction of stitching backwards-forwards-left-right.

In document FR-A-467.481 there are wheels with pins on the outer circumference, commanded by a perforated flexible belt into the holes of which the pins enter, instead of the rectilinear rack.

However, these documents refer to embroidery machines, not to multi-needle quilting machines.

Quilting machines, as we have said, have a working speed at least in the range of 450 stitches per minute, compared with a maximum speed in embroidery machines of about 120 stitches per minute.

Moreover, whereas in embroidery machines the fabric is cut into pieces, attached manually onto appropriate frames before the embroidery operation, and removed always manually when the work is finished, in quilting machines the fabric or the sandwich of material which is to be quilted is unwound continuously from rolls, with a huge saving in time and effort for the workers.

In embroidery machines the needles work in a horizontal direction, whereas in quilting machines they work in a substantially vertical direction.

In quilting machines there is at least a pressure plate on which the wheels through which the thread passes are mounted, with the respective command organs, whereas in embroidery machines there is no pressure plate whatsoever.

The final products obtained from quilting machines are essentially quilted bed-covers which can also be embroidered, whereas in embroidery machines the final products consist of any type of embroidery or decoration on single-layer fabrics of a decorative type.

Conventional devices, moreover, do not give the possibility of carrying out step by step, with the position of the wheels, the desired program of embroidery; therefore they do not allow to achieve designs of absolute precision with the cord threads, ribbons or additional threads; nor do they allow to alternate on command segments where the cord thread or ribbon is applied with segments of simple stitching to achieve particular ornamental patterns according to a pre-determined sewing program.

In conventional devices, moreover, it is not always possible, at every step of the program, to direct the hole through which the embroidery thread passes perfectly in front of the needle according to the direction of sewing, with discrepancies of a fraction of a degree; nor is it possible to exclude the alternate rotation of the wheels.

This does not allow these conventional devices to sew exactly in the center, whatever may be the direction of sewing, ribbons, tapes and flat trimmings and to attach them on the basic fabric, nor to alternate segments where ribbon or cord thread is applied with segments of simple stitching, thus limiting the applications and possibilities.

The Applicant has devised and embodied this invention in order to overcome this shortcoming of the state of the art, which has never provided or hypothesised applications of this type on multi-needle quilting machines, given the difficulty of using embroidery techniques previously employed only on machines which were operationally and technologically completely different, and to obtain further advantages as shown hereafter.

SUMMARY OF THE INVENTION

The invention is set forth and characterized in the respective main claims, while the dependent claims describe other characteristics of the main embodiment.

The purpose of the invention is to provide a device, and the relative method, to apply cord thread, ribbons or trimming, suitable to be applied onto a quilting machine, particularly a multi-needle machine, in order to work fabrics fed continuously from a roll with a speed in the region of 450 stitches a minute and which can reach 600 to 700 stitches a minute.

A further purpose is to achieve a quilting machine including the device described above, suitable to continuously work fabrics, simple and padded, obtaining any ornamental design whatsoever of the stitches by means of electronic control.

A quilting machine on which the device according to the invention is applied comprises at least a needle-bearing bar, on which a plurality of needles are mounted in alignment.

The needle-bearing bar is equipped with alternate ascending/descending motion to take every needle to co-operate with a mating lower sewing element, consisting of a shuttle, a rotary crochet or a movable hook also equipped with alternating motion mating with the movement of the needle-bearing bar.

The co-operation between the needles, each of which is fed with its own thread called needle thread, and the lower sewing elements causes stitches to be made on the fabric, fed continuously from rolls and located between the sewing organs.

The quilting machine according to the invention also comprises at least a pressure plate equipped with movement mating with the movement of the needle-bearing bars.

According to the invention, a plurality of devices, able to apply ribbon or cord thread onto the fabric according to a desired ornamental pattern, are mounted on the pressure plate in correspondence with pre-selected specific needles or specific groups of needles.

Each of these devices consists of a fixed assembly part, solid with the relative pressure plate, and a movable part suitable to be made to rotate by drive means according to a desired, variable angle.

The drive means may be commanded mechanically, electrically, pneumatically, hydraulically, magnetically or otherwise.

The movable part is equipped with at least a hole or eyelet through which, according to the individual case, the ribbon or the cord thread to be applied pass, supplied by suitable feeding reels. In a preferential embodiment of the invention, the eyelet is eccentric with respect to the axis of rotation of the movable part.

In a preferential embodiment, the movable part consists of a detachable insert, equipped with at least a hole and at least an eyelet which are eccentric with respect to the hole through which the needle passes.

According to whether the application concerns ribbon or cord thread, the insert may be detached and re-attached directed in a different manner with respect to the fixed assembly part, so that it is possible to cover both options with a single element.

According to a variant, the insert can be replaced according to the diameter of the ribbon and/or the cord thread to be applied.

According to a further variant, the insert has a plurality of holes and/or eyelets in order to cover a range of diameters of ribbons and/or cord threads with a single, directable element.

During normal sewing operations, made with alternate movements of the needle-bearing bar and the mating pressure plate, the moving part of the application device is made to rotate alternately around its own axis of rotation by alternately activating the respective drive means.

The rotation of the movable part, carried out in co-ordination with the vertical, alternating movement of the sewing needles, may take place with angles of different amplitude with reference to the direction of sewing.

In the case of ribbons being applied, which are sewn directly onto the fabric by the needle thread, the angles of rotation determined by the command program of the machine are such as to keep the eyelet through which the ribbon passes in a position which is always in front of the needle according to the direction of sewing of the various steps of the pattern to be achieved.

In this way the stitching is always made perfectly in the center of the ribbon.

In the case of cord threads or yarns of the Lurex® type being applied, the invention not only directs the position of the eyelet, or hole, to a position which is always in front of the needle according to the direction of sewing; it is also possible, with this invention, to impart to the movable part alternate, symmetrical rotations in the two directions with respect to this basic position, with angles which are programmed in such a manner that the cord thread or Lurex® yarn, which pass through the eyelet or hole, wind alternately in a spiral around the relative sewing needle.

In this case, the cord thread is not sewn directly by the needle thread but winds around said thread and is attached to the fabric between two consecutive sewing stitches.

The angles of alternate rotation of the movable part may be of variable amplitude, for example in the range of about 80°, to ensure that the cord thread winds around the sewing needle.

The rotation of the movable part also confers a torsion which binds the needle thread and the cord thread together.

The cord thread wound around the needle is sewn in this way, with every sewing cycle, by the needle thread and is fixed to the fabric fed continuously to the machine.

A variant of the invention provides that, during the application of the ribbon or cord thread, the rotation of the movable part may be interrupted on command at predetermined points of the pattern being formed, in a position such that it does not create interference with the sewing needle, and subsequently re-started at other points. In this way, we achieve segments where the ribbon or cord thread is applied in alternation with segments of simple sewing with the needle thread, in order to achieve ornamental designs characterized by such alternation.

During the sewing cycle, the fabric is subjected to controlled displacements—to-and-fro, right-left—by the command unit of the sewing machine according to the pattern to be made.

By properly programming the movement of the fabric, any type whatsoever of ornamental pattern can be made, from the simplest, with a linear development, to the most complex, substantially comparable to an embroidery.

With the device according to the invention it is possible to apply ribbon, cord thread or similar onto continuously fed fabric, according to the pattern made by the machine, with a much higher speed and with much thicker and more continuous patterns compared with those made in any other type of machine known in the state of the art, with an obvious advantage in terms of productivity and variety of application.

The machine which adopts the device according to the invention can be used as a normal quilting machine, for example a multi-needle quilting machine, by excluding the device; or as an embroidery machine to apply ribbon, cord thread or similar onto simple or padded fabrics fed continuously; or again as a machine which simultaneously achieves quilts and also the application of the ribbon, cord thread or similar, thus obtaining mixed patterns with innovative and original characteristics.

BRIEF DESCRIPTION OF THE DRAWINGS

These and other characteristics of the invention will become clear from the following description, given as a non-restrictive example, of some preferential forms of embodiment of the invention with reference to the attached drawings wherein.

DETAILED DESCRIPTION OF PREFERRED EMBODIMENTS

Figure 1:
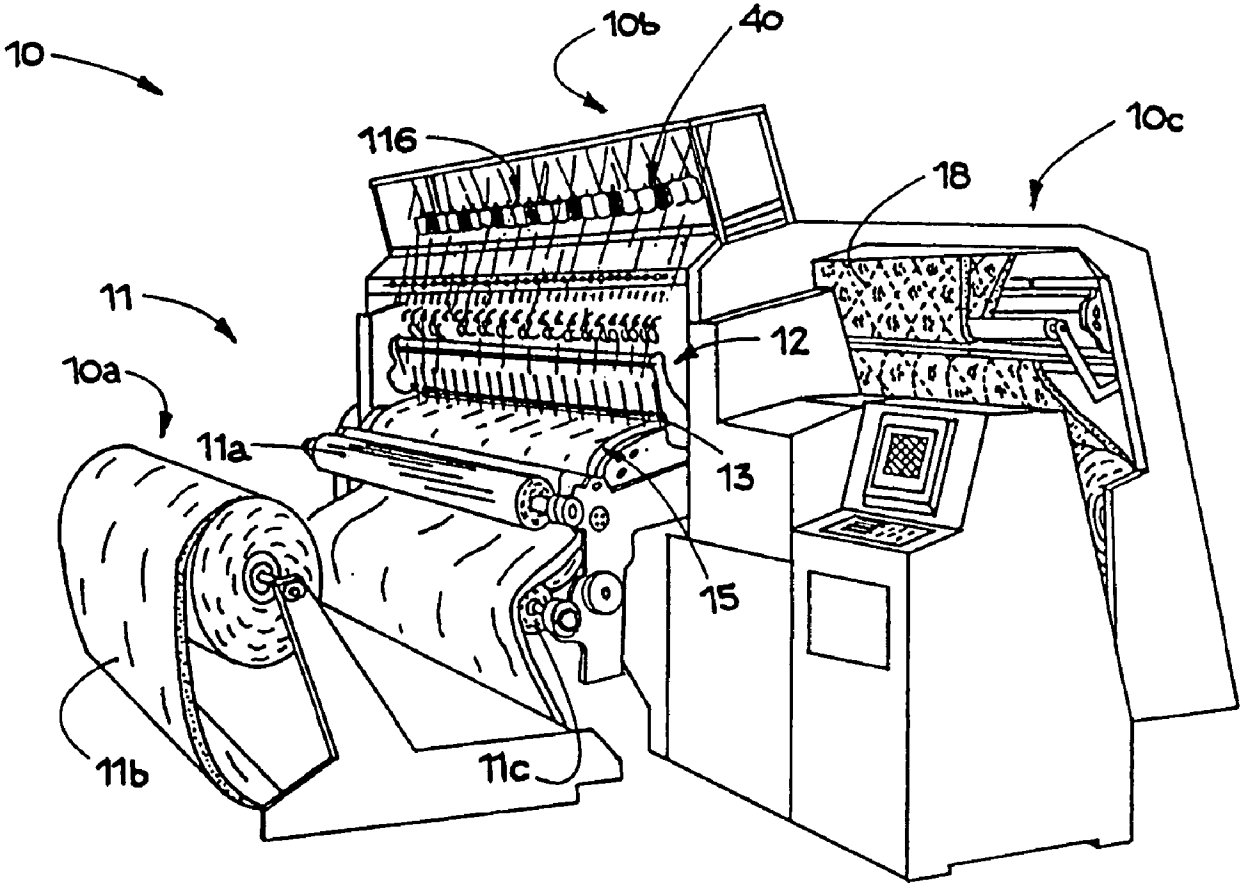
FIG. 1 is a schematic view of an electronically commanded multi-needle quilting machine of the type suitable to comprise a device to apply a ribbon or cord thread according to the invention.

FIG. 1 shows an electronically controlled multi-needle quilting machine 10 of a general type which is substantially known. The quilting machine 10 comprises, as its essential parts, an inlet assembly 10*a*, a sewing assembly 10*b* and an outlet assembly 10*c*.

The inlet assembly 10*a* is used to feed the textile material 11 which has to be worked. The inlet assembly 10*a* is managed and controlled by software and is therefore able to move the textile material 11 in any direction whatsoever, to-and-fro or right-left, in order to achieve any type of pattern, even extremely complex ones.

The sewing assembly 10*b* comprises upper sewing organs 12 and lower sewing organs 15 of a conventional type.

The upper sewing organs 12 consist, in this case, of two parallel needle-bearing bars 13, respectively 13*a* and 13*b*, on which respective aligned needles 14 are assembled, each co-operating with a respective thread 16, called the needle thread, fed from respective reels 116 arranged in the upper part of the machine 10.

Figure 2:
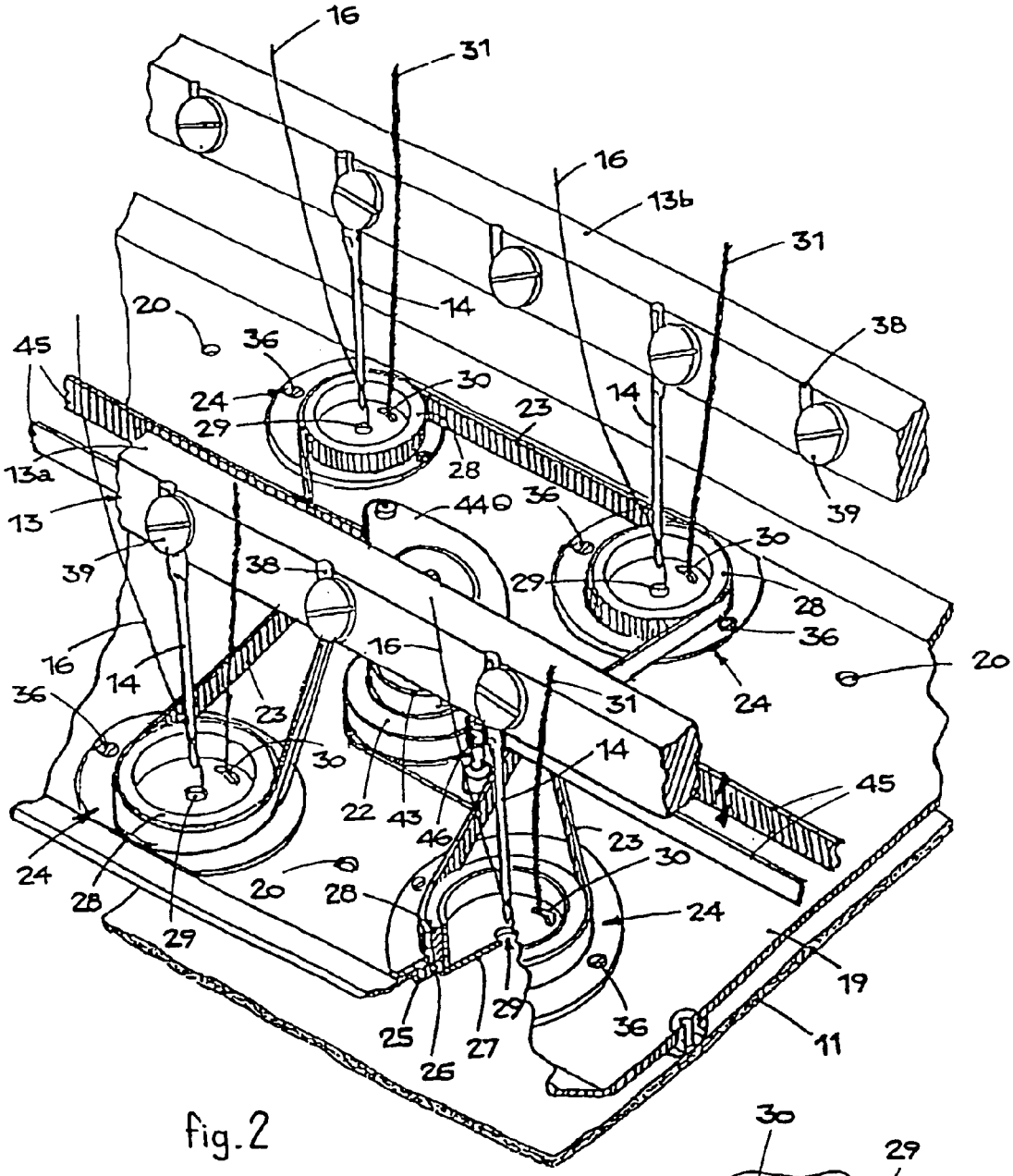
FIG. 2 is a schematic view of four devices to apply a ribbon or cord thread according to the invention suitable to co-operate with two relative needle-bearing bars of the quilting machine shown in FIG. 1.
Figure 6:
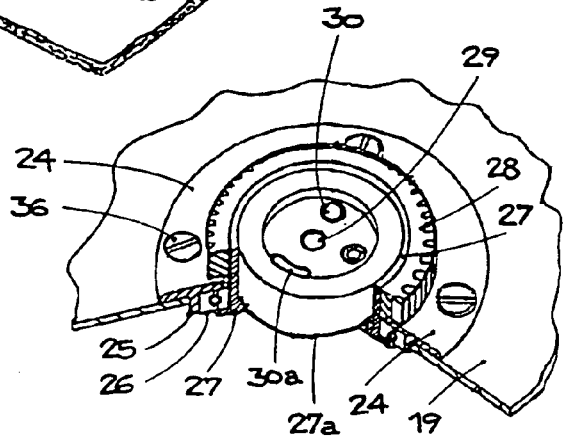
FIG. 6 shows in a detail a preferential embodiment of the invention.
Figure 3:
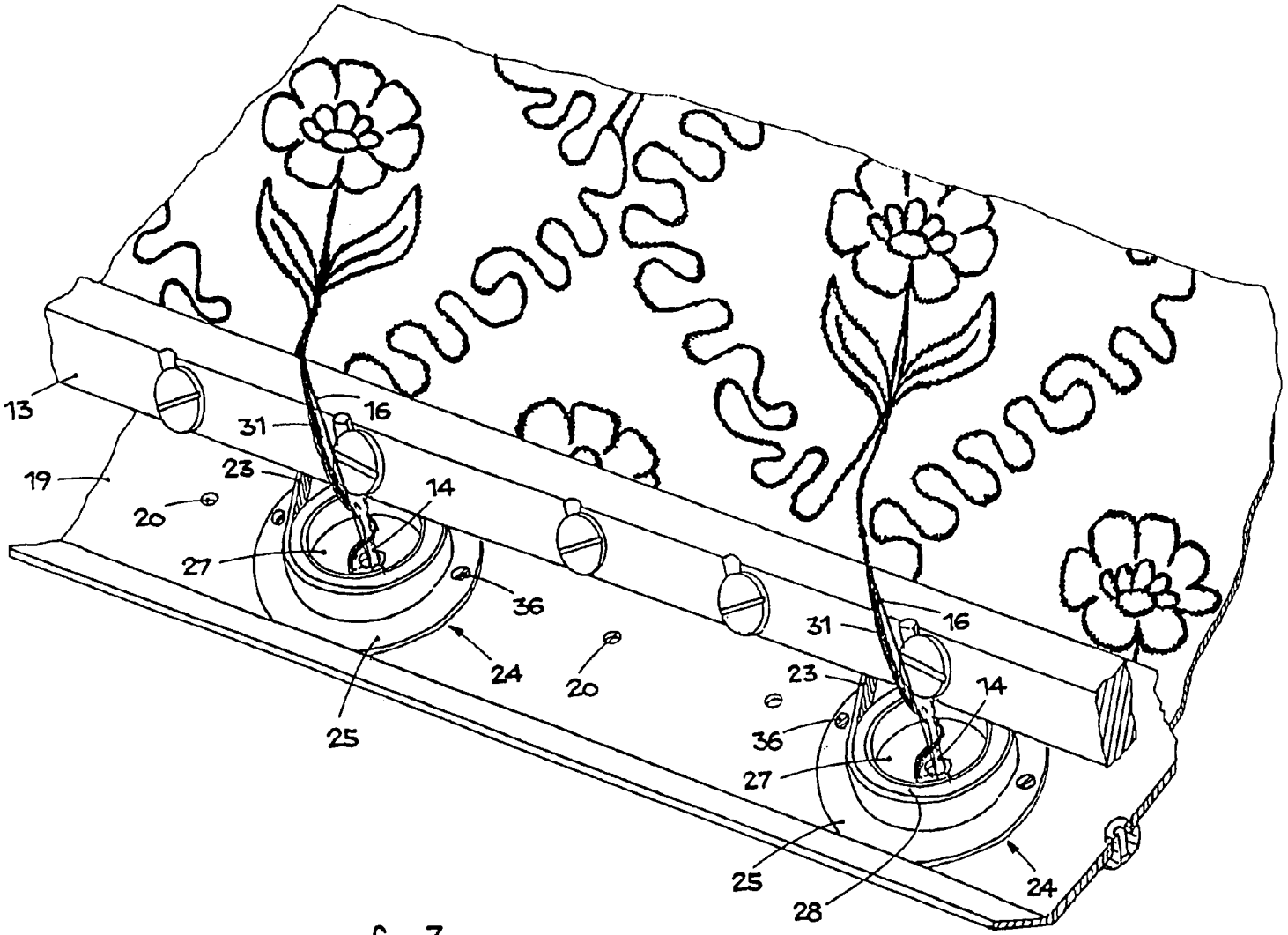
FIG. 3 shows the device in FIG. 2 during the working step.

The needle-bearing bar 13 includes needle-positioning seatings 38 associated with means 39 to clamp the needles 14 into position. For a better understanding of the invention, FIG. 2 shows only a few needles 14, as it is obvious that according to the type of stitch to be done all the seatings 38 can house a relative needle 14.

The needle-bearing bars 13*a* and 13*b* are equipped with alternate ascending-descending motion to take the needles 14 into co-operation with the respective lower sewing organs 15, consisting of shuttles, rotary crochets or alternately moving hooks, in a conventional manner.

The co-operation between the sewing organs 14 and 15 causes a plurality of stitches 18 to be made simultaneously on the textile material 11; according to the movement imparted to the textile material 11, the stitches 18 achieve desired patterns to obtain the quilted textile product which is collected by the outlet assembly 10*c*.

During the sewing cycle the needle-bearing bars 13 co-operate with a pressure plate 19, also equipped with an alternate ascending-descending motion correlated to the movement of the needle-bearing bars 13.

The function of the pressure plate 19, in this case, is to descend and compress the padded textile materials 11 as the stitch is being formed, in order to improve the quality of the stitches 18; it re-ascends immediately afterwards to allow the material 11 to move.

There are a plurality of holes 20 made on the pressure plate 19 and arranged in correspondence with the needles 14 in order to allow them to pass when the needle-bearing bar 13 is in the descending step.

In this case, a plurality of devices 24 are mounted on the pressure plate 19 in suitable reciprocal positions and are suitable to apply ribbon 31*a*, cord thread 31 or similar onto the textile material 11 subjected to sewing, the ribbon 31*a* or cord thread 31 being fed from their own reels 40 installed on the machine 10, and controlled by suitable thread-brakes, which are not shown here, able to ensure that they are constantly under tension.

Each device 24 consists of a stationary assembly flange 25, made solid with the pressure plate 19 by means of screws 36, inside which an annular bearing 26 is mounted on which a ring 27 is suitable to rotate.

The ring 27 is solidly connected with a toothed pulley 28 associated with drive means.

In this case, the drive means consist of one or more brushless motors 21, managed by the electronic command program of the quilting machine 10 by means of suitable drives.

In this case, the brushless motor 21 is fixed in a central position to the cross-piece of the quilting machine 10 by means of screws 35 and is equipped with a telescopic grooved shaft 42 which makes a rotary toothed pulley 43 rotate, with bearings, on a support 44 attached to the pressure plate 19, of which the pulley 43 follows the vertical, alternating, ascending-descending movements.

Two toothed belts 45 are engaged on the pulley 43; in turn, one towards the right and one towards the left in co-operation with appropriate return and tensioning rollers 46, the toothed belts 45 command two other toothed pulleys 143, rotating on bearings on relative supports 144 attached to the pressure plate 19.

On each of the pulleys 143 two other toothed belts 145 are engaged, which command, one towards the right and one towards the left, two other toothed pulleys rotating with bearings on relative supports attached to the pressure plate 19 and so on.

A toothed pulley 22 is attached to the lower part of each toothed pulley 43, 143, . . . , rotating with bearings on the relative supports 44, 144, . . . attached to the pressure plate 19.

The toothed pulley 22 is able to draw a belt 23 into rotation; the belt 23, in this case, winds around the respective toothed pulleys 28 of two application devices 24.

There are return and tensioning rollers 33 in co-operation with the belt 23.

A replaceable insert 27*a* is inserted into the rotary ring 27 and has a substantially central through hole 29, which allows the relative needle 14 to pass when the bar 13 is lowered to make the stitch. An eccentric eyelet 30*a* and an eccentric hole 30 are respectively made on the insert 27*a*; selectively and according to the specific application, these have the function of allowing to pass respectively the ribbon 31*a* or the cord thread 31 which have to be sewn or attached by the thread 16 onto the textile material 11.

In practice, according to the type of application, the insert 27*a* will be assembled on the relative ring 27 in such a manner as to selectively locate either the eyelet 30*a* or the hole 30 in the working position, according to whether the process concerns a ribbon 31*a* or a cord thread 31. According to the variation in the diameters of said elements 31, 31*a*, the insert 27*a* can be replaced by another, analogous insert but equipped with holes or eyelets of different diameters.

It also comes within the field and scope of the invention to provide the insert 27*a* with a plurality of holes 30 or eyelets 30*a* of different diameter according to the diameter of the element 31, 31*a* which is to be applied.

During the stitching cycle of the ribbon 31*a*, the brushless motor 21 is made to rotate and, by means of the toothed pulleys 43, 143, the toothed belts 45, 145, the toothed pulleys 22, the belts 23, the toothed pulleys 28 and the relative rings 27 and inserts 27*a*, said eyelets 30*a* in which the ribbons 31*a* pass are directed, with every sewing stitch, into a position which is always in front of the needle with respect to the direction of stitching.

In this way, the stitching is always perfectly in the center of the ribbon 31*a*.

During the stitching cycle of the cord thread 31, the brushless motor 21 is made to rotate alternately, making the toothed pulleys 43, 143, the toothed belts 45, 145, and the toothed pulleys 22 rotate.

The alternate motion of rotation is transmitted through the belt 23 to the toothed pulleys 28 and from them to the relative rings 27 and inserts 27*a*.

The alternate rotation of the rings 27 and the relative inserts 27*a* causes the cord thread 31 to be wound in a spiral, passing through the eccentric hole 30, around the relative needle 14 and its thread 16, through an angle determined by the angle of rotation of the rings 27.

The amplitude of the angle of alternate rotation of the rings 27 is variable and, in this case, is equal to about 80° with a base position at every stitch always in front of the needle 14 with respect to the direction of sewing, to ensure that the cord thread 31 winds around the relative needle 14.

In this condition the cord thread 31 is then drawn downwards by the descending movement of the needle 14, and sewn onto the textile material 11 together with the needle thread 16, according to the ornamental pattern or design programmed on the machine 10.

FIGS. 5*a*–5*g* show some possible patterns which can be made with the method and device according to the invention.

Figure 5E:
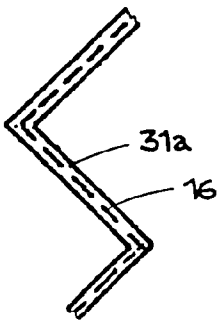
FIGS. 5*a*–5*g* show some examples of patterns which can be obtained with the machine according to the invention.
Figure 5F:
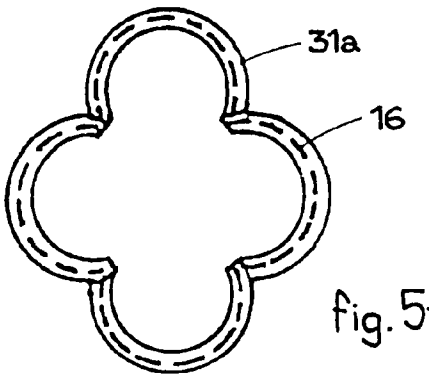
Figure 5G:
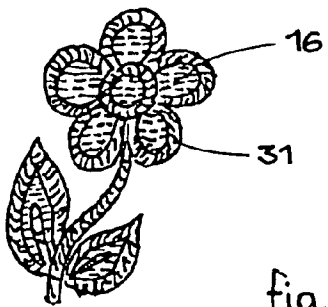
Figure 5B:
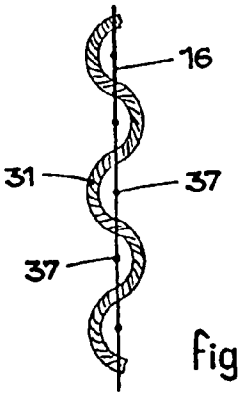
Figure 5D:
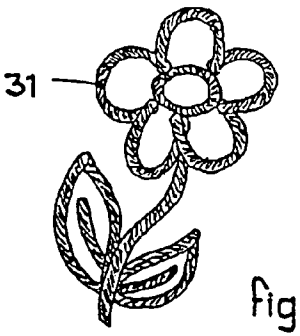
Figure 5A:
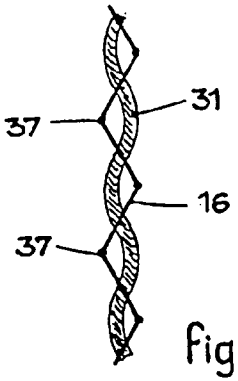

FIGS. 5*a* and 5*b* refer to simple designs, wherein the needle thread 16 is applied respectively in a zigzag and linearly, and the cord thread 31 is positioned alternately on one side and the other thereof for each stitch 37.

Figure 5C:
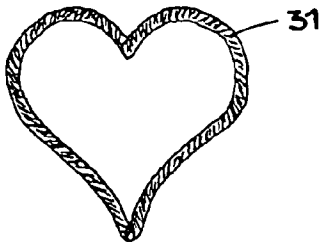

FIGS. 5*c* and 5*d* refer to more complex designs, to create particular ornamental patterns substantially similar to embroidery.

As the cord thread 31 is wound in a spiral around the needle 14 and its thread 16, this causes a torsion which binds the cord thread 31 and the thread 16 closely together.

FIGS. 5*e* and 5*f* refer to simple and complex designs wherein the ribbon 31*a* is applied with a stitch by the thread 16 onto the textile material 11.

FIG. 5*g* refers to particular, elaborate designs which can be obtained with the invention wherein, according to the specific ornamentation to be carried out, it is possible to alternate segments wherein the cord thread 31 or the ribbon 31*a* is applied with segments wherein this application is momentarily interrupted to perform simple stitching with sewing thread 16.

This allows, for example, to achieve designs with outer perimeters formed by additional cord thread 31 and inner portions filled with simple stitches made by the sewing thread 16 (FIG. 5*g*).

During the steps of simple sewing with thread 16, the stop position of the eccentric holes or eyelets 30*a* and 30 of the inserts 27*a* is programmed so that the cord thread 31 or the ribbon 31*a* are always in a position opposite to the direction of sewing, so that they are not sewn or accidentally attached to the fabric.

Moreover, the thread-brakes which co-operate with the respective cord threads or ribbons are activated to impart thereto a constant tension; this prevents them from floating freely during the steps of normal sewing, so that they are not accidentally sewn or attached by the sewing thread 16.

Figure 4A:
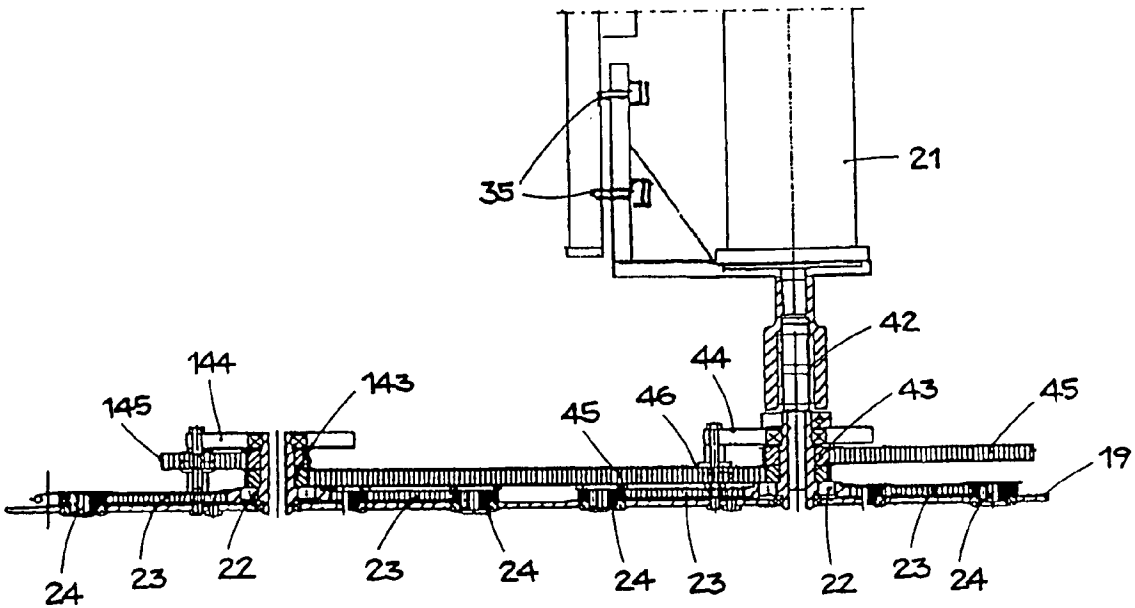
FIGS. 4*a* and 4*b* show a plane and a raised view of a possible embodiment of the device according to the invention.
Figure 4B:
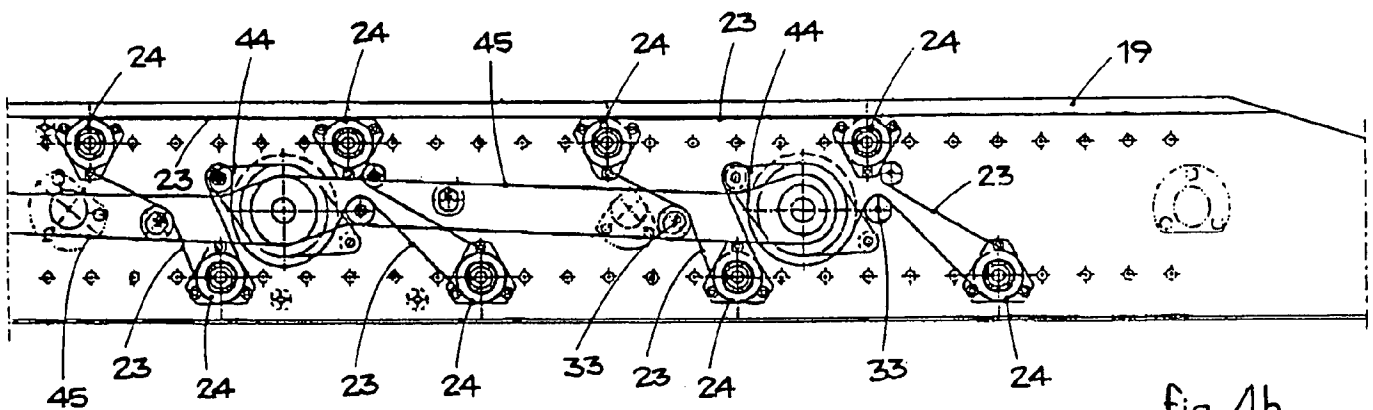

FIG. 4*b* is a bird's eye view of a pressure plate 19 on which two devices as shown in FIG. 2 are assembled.

It is obvious that, according to an evolution of the invention, these devices can be displaced on the plate 19 into the desired positions in relation to the pattern to be made.

FIG. 4*b* shows an embodiment wherein a single brushless motor 21 simultaneously commands four devices 24 thanks to the configuration of the belt 23 and the three return and tensioning rollers 33.

It is also obvious that the devices 24 can be driven, instead of by the brushless motor 21, by any suitable drive means—pneumatic, mechanical, hydraulic or otherwise.

For example, a rack may be provided, driven by a pinion provided for the purpose, suitable to co-operate with the respective toothed pulleys 28 of all the devices 24 arranged in a row, there being included another independently driven rack for the devices 24 located in another row.

Or, there may be a pneumatic actuator for pairs or fours of devices 24. Again, the movement may be imparted by alternately activating an electromagnetic device, a hydraulic device or otherwise.

Moreover, even though this description refers to two needle-bearing bars 13*a* and 13*b*, the invention can also be applied in the case of three or more needle-bearing bars.

The machine 10 described above therefore allows to continuously work textile material 11 supplied from rolls at an extremely high speed, up to 600÷700 stitches a minute and more, obtaining the desired ornamental patterns, from the simplest to the most complex.

Moreover, the machine 10 is extremely versatile in that it allows to make simple quilting by excluding the devices 24, to simply apply the ribbon 31*a* or cord thread 31 if only the needles 14, in correspondence with which the devices 24 are present, are used, applications of ribbon 31*a* or cord thread 31 alternated with simple stitching by alternating on command the rotation and arrest of the devices 24, and to make combined products if both the needles 14 co-operating with the devices 24, and also those not co-operating with them, are used.

The machine 10 according to the invention is also easy to prepare since, to support and position the devices 24, it uses elements such as the pressure plate 19 which are already included in a normal quilting machine.

What is claimed is:

1. A device for applying an embroidery material onto a textile fabric comprising:

(a) a device for continuously feeding the textile material;

(b) an upper sewing organ comprising at least a needle bearing bar supporting a plurality of needles with respective sewing threads to form respective stitches onto the textile fabric;

(c) a lower sewing organ comprising at least one sewing organ selected from the group consisting of shuttles, rotary crochets and moving hooks, wherein the co-operation of the upper sewing organ and the lower sewing organ results in a desired stitched pattern in the textile fabric;

(d) at least one pressure plate, wherein the pressure plate descends to compress the textile fabric;

(e) a plurality of embroidery making devices for applying the embroidery material onto the textile fabric, wherein the embroidery making devices are mounted on the pressure plate; and a drive device that imparts a rotational motion to the embroidery making device, wherein the drive device includes a hole for each needle to pass through and a second hole for the embroidery material to pass through, and wherein the rotational motion is in a single direction so as to direct the second hole in a position that is in front of the needle to obtain stitches on the textile fabric and to fix the embroidery material, wherein the drive device comprises a pneumatic actuator.

2. A device for applying an embroidery material onto a textile fabric comprising:

(f) a device for continuously feeding the textile material;

(g) an upper sewing organ comprising at least a needle bearing bar supporting a plurality of needles with respective sewing threads to form respective stitches onto the textile fabric;

(h) a lower sewing organ comprising at least one sewing organ selected from the group consisting of shuttles, rotary crochets and moving hooks, wherein the co-operation of the upper sewing organ and the lower sewing organ results in a desired stitched pattern in the textile fabric;

(i) at least one pressure plate, wherein the pressure plate descends to compress the textile fabric;

(j) a plurality of embroidery making devices for applying the embroidery material onto the textile fabric, wherein the embroidery making devices are mounted on the pressure plate; and a drive device that imparts a rotational motion to the embroidery making device, wherein the drive device includes a hole for each needle to pass through and a second hole for the embroidery material to pass through, and wherein the rotational motion is in a single direction so as to direct the second hole in a position that is in front of the needle to obtain stitches on the textile fabric and to fix the embroidery material, and wherein the drive device comprises a pneumatic actuator, wherein the drive device comprises a hydraulic actuator.

* * * * *